United States Patent [19]

Radcliffe

[11] Patent Number: 4,890,078

[45] Date of Patent: Dec. 26, 1989

[54] DIPLEXER

[75] Inventor: Christopher J. Radcliffe, Luton, Great Britain

[73] Assignee: Phase Devices Limited, Luton, England

[21] Appl. No.: 180,572

[22] Filed: Apr. 12, 1988

[51] Int. Cl.[4] ..... H01P 5/12

[52] U.S. Cl. ..... 333/134; 333/203; 333/230

[58] Field of Search ..... 333/125, 126, 134, 135, 333/136, 202, 203, 206, 212, 222, 230; 455/78

[56] References Cited

U.S. PATENT DOCUMENTS

| | | | |
|---|---|---|---|
| 4,166,256 | 8/1979 | Shishido | 333/231 X |
| 4,216,448 | 8/1980 | Kasuga et al. | 333/206 X |
| 4,307,357 | 12/1981 | Alm | 333/206 |
| 4,360,793 | 11/1982 | Rhodes et al. | 333/209 X |
| 4,453,146 | 6/1984 | Fiedzruszko | 333/212 |
| 4,742,562 | 5/1988 | Kommrusch | 333/134 X |

FOREIGN PATENT DOCUMENTS

| | | | |
|---|---|---|---|
| 2653856 | 2/1978 | Fed. Rep. of Germany | 333/206 |
| 3028925 | 2/1982 | Fed. Rep. of Germany | 333/134 |
| 0103655 | 8/1979 | Japan | 333/212 |
| 0102902 | 8/1980 | Japan | 333/206 |

OTHER PUBLICATIONS

Mole, Richard L., "A Numerically Optimized Contiguous Diplexer", 1979, pp. 285 and 286 (Abstract) IEEE MTT-S.

Pfitzenmaier, Gerhard, "Synthesis and Realization of Narrow-Band Canonical Microwave Bandpass Filters Exhibiting Linear Phase and Transmission Zeros", Sep. 1982, IEEE, vol. MTT-30, No. 9, pp. 1300-1311.

*Primary Examiner*—Eugene R. LaRoche
*Assistant Examiner*—Seung Ham
*Attorney, Agent, or Firm*—Spencer & Frank

[57] ABSTRACT

A diplexer having receive and transmit sections connected to a common port comprises square-cross section cavities arranged in rows and columns. At least three adjacent cavities form a triangular group in which the non-adjacent cavities are cross-coupled. The cross coupling means comprises an inductive loop or a capacitative probe. Adjacent cavities in each section are also coupled, on folded paths, by irises. Cavity wall thickness is reduced where possible. The antenna port is diplexed to both sections by a T-branch connector having wire sections which are tapped into central resonators at a predetermined distance above electrical ground. Low pass filters with non-overlapping peak responses provide further isolation between the sections.

8 Claims, 5 Drawing Sheets

INSERTION LOSS AND RETURN LOSS

REJECTION-NETWORK AND SPECTRUM ANALYSER MEASUREMENTS.

DIPLEXER

This invention relates to a diplexer which may be used, for example, in a satellite communications system in the L Band. However, the diplexer can have other applications.

BACKGROUND TO THE INVENTION

Several L-Band global and area mobile satellite communications system are presently in operation and others are in an advanced planning stage. A system for satellite communication with passenger aircraft is also about to go into operation.

The aeronautical satellite communications system (Avsatcom) enables aircraft to satellite communication in the L Band and it provides a satellite to shore link in the C Band. For satisfactory operation in these bands, however, a diplexer must satisfy stringent specifications. For example, typical Inmarsat Specifications are shown below in Tables 1A and 1B and these may be compared with the more recent requirements shown in Table 2.

TABLE 1A

TYPICAL INMARSAT STANDARD A DIPLEXER SPECIFICATION

| PARAMETER | RECEIVE | TRANSMIT | |
|---|---|---|---|
| Frequency Range | 1535–1543.5 | 1636.5–1645.0 | MHz |
| User Bandwidth | 8.5 | 8.5 | MHz |
| Rejection at other channel | 120 | 95 | dB |
| Insertion Loss | 0.7 | 0.7 | dB |
| Transmit Power | | 50–100 | W |
| Ratio channel separation/ bandwidth | | 11.7 | |

TABLE 1B

TYPICAL INMARSAT STANDARD B DIPLEXER SPECIFICATION

| PARAMETER | RECEIVE | TRANSMIT | |
|---|---|---|---|
| Frequency Range | 1530–1545.0 | 1625.5–1646.5 | MHz |
| User Bandwidth | 15.0 | 20.0 | MHz |
| Rejection at other channel | 120 | 95 | dB |
| Rejection to 4 GHz | 70 | 70 | dB |
| Rejection 4 to 20 GHz | 50 | 50 | dB |
| Insertion Loss | 0.7 | 0.7 | dB |
| Transmit Power | | 50–100 | W |
| Ratio channel separation/ bandwidth | | 5 | |

TABLE 2

AERONAUTICAL DIPLEXR OUTLINE SPECIFICATION

| PARAMETER | RECEIVE | TRANSMIT | |
|---|---|---|---|
| Frequency Range | 1530–1559 | 1626.5–1660.5 | MHz |
| Bandwidth | 29 | 34 | MHz |
| Return Loss | 20 | 20 | dB |
| Insertion Loss | 08 | 0.8 | dB |
| Rejection at other channel | 120 | 120 | dB |
| Rejection 1565 to 1585 | | 100 | dB |
| Transmit Power | | 40–100 | W |
| Ratio channel separation/ bandwidth | | 2.91 | |

Whilst Inmarsat Standard A requirements may be met with two chebycheff filters as used in conventional diplexer, the next generation of Inmarsat spacecraft at present under construction require larger bandwidth as set out by the major specification points outlined in Table 2.

As can be seen, a lower separation to bandwidth is now required for the transmit filter as well as over 100 dB of rejection relatively close to the transmission passband. This is to protect nearby GBF receivers on an aircraft.

OBJECTS OF THE INVENTION

It is therefore an object to the invention to provide an improved diplexer having better insertion loss, rejection and volume e.g. over conventional chebycheff designs and which may be used, for example, for many different L Band or other communication systems.

It is another object of the invention to provide a diplexer having a design which facilitates manufacture.

It is a further object of the invention to provide a diplexer with a high degree of isolation between its respective signal filtering sections.

It is yet a further object of the invention to provide a diplexer which provides improved rejection between input and output (e.g. transmit and receive ports) upto very high frequencies, for example, greater than 20 Gigaherz.

BRIEF DESCRIPTION OF THE DRAWINGS

These and other objects and advantages of the invention will be appreciated from the following descriptions of a preferred embodiment taken in conjunction with the accompanying drawings in which.

SUMMARY OF INVENTION

Figure 1:
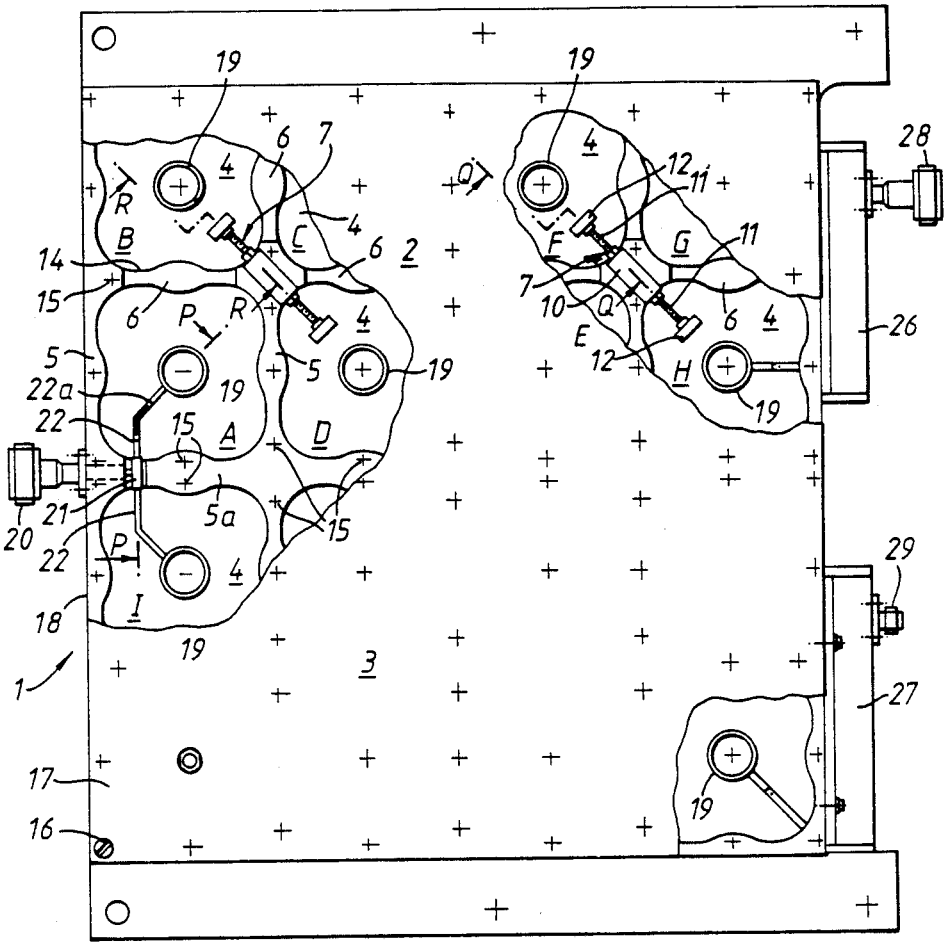
FIG. 1 is a plan view, partly sectioned, of a diplexer according to one embodiment of the invention.

In its broader aspect, a diplexer according to the invention comprises first and second filtering sections which may be used, for example, for filtering respective receive and transmit signals. A common port, such as an antenna port, is coupled to both sections and respective first and second ports are provided, for example, for the receive and transmit signals. Within the body of the diplexer are walls defining a plurality of coaxial cavities. Each of these cavities has a substantially square cross-section and a central resonator. The cavities are disposed in each of the sections so that at least three adjacent cavities form a triangular group in which two of the three cavities are aligned in a column and two of the three cavities are aligned in a row. The cavities in each section have irises for coupling together the respective adjacent cavities on a main path between the respective ports and in addition to these irises, cross coupling means are provided for diagonally coupling the non-adjacent cavities in each of the triangular groups.

Such an arrangement leads to a surprisingly good improvement in the performance of the diplexer, besides facilitating its production. In the latter respect, the cavities in the first and second sections are arranged in respective aligned rows and columns, in contrast to an arrangement where the cavities in one row (or column) may be offset from those in an adjacent row (or column), and aligned rows and columns are far easier to make. In such an arrangement, the respective main paths, between ports, are folded back and forth like a zig-zag and this provides for the possibility of cross-coupling along either or both diagonals of a square in which four adjacent cavities are located, i.e. in two rows and columns. Either or both of these diagonals may be used in cross coupling in accordance with design requirements.

The diplexer according to the invention effectively provides two filters each having stop poles in the adjacent passband. The stop poles are realised in the invention, without staggering the cavities, by using the "diagonal" coupling in the above-mentioned "aligned" arrangement. To produce a stop pole on the high side (e.g. transmit side) of the filter, inductive couplings are required and a loop is the preferred method of coupling. To produce a stop pole on the low side (e.g. receive side) of the filter, capacitative couplings are required, such as probes.

Instead of providing walls of substantially uniform thickness, i.e. the thickness being largely determined by the amount of material required to accept tapped bores for receiving screws to secure a cover for the cavities, the preferred embodiment has walls with portions of reduced thickness except for regions where means are provided for securing the cover. When starting with a cavity of substantially square cross-section, reducing the wall thickness by machining tends to leave arcuate corners extending away from the center of the square cross-section.

In the preferred embodiment of the invention, the common port is coupled to respective cavities in the first and second sections by a specially designed coupling means. Such coupling means has properties which depend on factors including the length of wire coupling sections and the height of a tapping point of one of the wire sections which is coupled to the central resonator of each cavity. The height of this tapping point is the distance between the floor of the cavity (at ground potential) and a position along the length of the central resonator which is (at a progressively higher potential above ground).

According to another aspect of the invention, which may be either combined with the various features mentioned above or used with a diplexer having a different construction, the first and second ports, e.g. which are coupled to the receive and transmit sections, are coupled to respective first and second low pass filters having predetermined different characteristics. As of the low pass filters has a flat plateau type of pass band and a peak response at some distance (i.e. frequency) from the pass band plateau. The characteristics of the low pass filters are different in that the frequency at which the peak occurs in one is spaced apart from the frequency at which the peak occurs in the other so that the first section of the diplexer is substantially isolated from the second section.

DESCRIPTION OF PREFERRED EMBODIMENTS

Referring to FIGS. 1–6, a diplexer 1 comprises transmit and receive sections 2 and 3 respectively. Each of these sections consists of silver-plated, combline cavities 4 each having a substantially square cross-section defined by respective walls 5. Some of the walls 5 define the outer boundaries of the diplexer whereas the other internal walls separate adjacent cavities. Passing centrally through the diplexer are solid walls **5*a* which divide the transmit section 2 from the receive section 3. Apart from these walls, the other internal walls are either solid, or have irises 6 which are more easily seen, in plan view, in the schematic diagram of FIG. 3. These irises 6** provide coupling between adjacent (i.e. side-by-side) cavities along a main path, indicated by the arrows, having a folded or zig-zag form.

Figure 3:
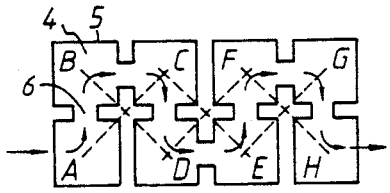
FIG. 3 is a diagram for illustrating the main path through either the transmit, or receive section of the diplexer.
Figure 2:
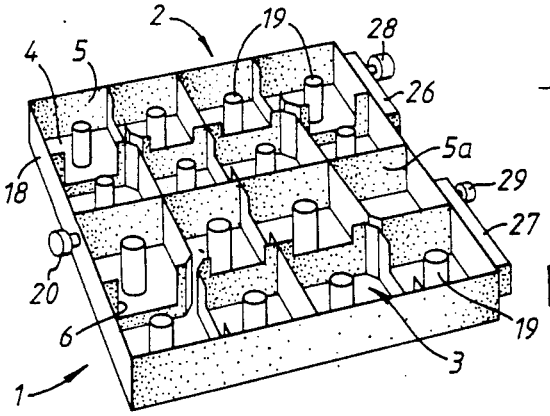
FIG. 2 is a simplified schematic and perspective view of the diplexer shown in FIG. 1 with a cover removed.
Figure 4:
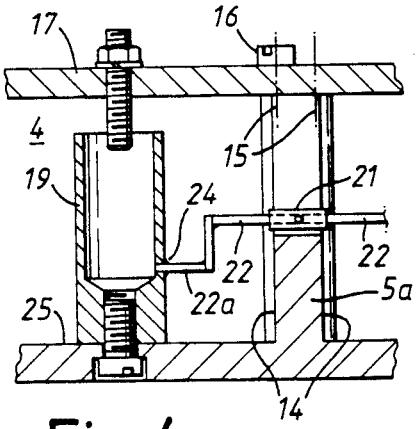
FIG. 4 is a section on line PP shown in FIG. 1 for illustrating how an antenna port is coupled to both the transmit and receive sections.

In addition to irises 6, certain cavities are cross-coupled by either capacitative probes 7 or inductive loops, 13. For example, FIG. 1 shows capacitative probes 7 which provide cross-coupling between cavities B and D, as well as cavities F and H. The broken lines in FIG. 3 illustrates the possibilities for cross-coupling since different cavities may be cross-coupled in accordance with design requirements.

Figure 5:
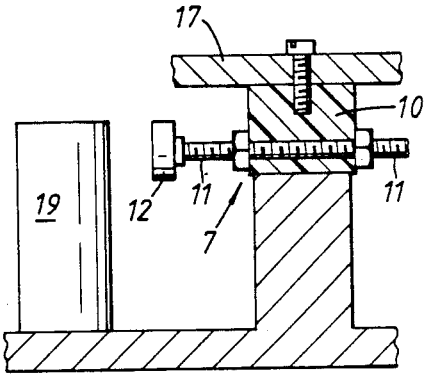
FIG. 5 is a section on lines QQ and RR as shown in FIG. 1, FIGS. 6*a*–6*c* are schematic view of a transverse inductive coupling formed by a loop; 6*a* being a section, 6*b* looking at a corner of a cavity, and 6*c* being a plan.
Figure 6C:
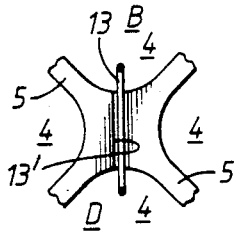
Figure 6A:
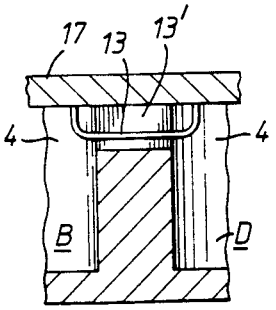
Figure 6B:
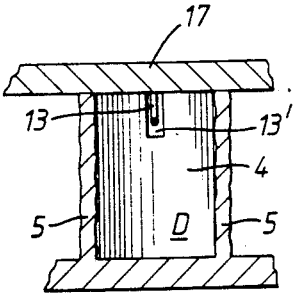

As shown in FIGS. 1 and 5, each capacitative probe consists of an insulating block 10 supporting a conducting rod 11 which has conductive discs 12 located at each end.

As shown in FIGS. **6*a*–6*c*, the inductive coupling is provided by an open loop of wire 13 received in, but supported clear of the walls of a slot 14 extending diagonally from, for example, cavity B to cavity D in place of the capacitative probe assembly shown in FIGS. 1 and 5**.

It will be noted that the cavities A, B, D and E, F, H form two triangular groups, each group having two cavities arranged in a row and two cavities arranged in a column. Moreover, in the preferred embodiment, the cavities are arranged in aligned rows and columns in each of the transmit and receive sections 2, 3 since this arrangement provides the above-mentioned possibilities for cross-coupling more cavities and it facilitates the machining of a block to form the cavities.

It will also be noted that the walls of each cavity have been machined to reduce their thickness in regions 14 which occur other than where tapped bores 15 are provided for receiving screws 16 to secure cover 17 to the body 18 of the diplexer 1. This tends to provide arcuate corners in each of the square cross-sections extending away from the center of the square.

Each cavity 4 contains a central resonator 19 of tubular construction. As the construction and operation of such resonators is known in the art, no further details need be given.

An external or common antenna port 20 is diplexed to resonators 19 of cavities A and I of the respective (transmit) and (receive) sections 2, 3. This diplxing is achieved by means of a T junction 21 connected by wire sections 22 having one end **22*a* which extends into a connector sleeve 23 at a tapping point 24 intermediate the ends of the respective central tubular resonator 19. The length and shape of the wire sections and the height of the tapping points 24 in the tubular resonator 19**, i.e.

above the floor 25 of the cavity 4 were designed to provide suitable matching characteristics for the transmit and receive sections 2, 3. In the illustrated embodiment, the wire sections 22 comprise parts secured to one another and forming a crank. However, the wire section 22 could be configured from a single piece of wire and, in some cases, it need not be cranked.

Any spurious cross-coupled signals are filtered out by the cavity structure of each section and also by low pass filters 26, 27 folded to lie along the rear cavity walls. These filters are provided with appropriate connectors 28, 29 to serve, in this case, as transmit and receive ports. The construction and operation of filters 26, 27 are described in more detail below.

With regard to the overall size of the diplexer, the preferred embodiment of the invention designed to meet the specification noted above was contained within a volume of 8.1×7.76×1.97 inches (206×197×50 mm).

Regarding the electrical design of the diplexer according to the invention, it is essentially a cross-coupled straight-line filter with real transmission poles situated in the adjacent passband (Table 2).

The individual filter designs were optimised using a pole placing program and the results are shown in Table 3. An allowance of 6 dB was made for rejection improvement due to diplexing. Using network-synthesis (e.g. along the lines of that disclosed in IEEE Trans. Microwave Theory Tech. Vol. MTT-31, Jan 83 pp 40–45 or Mohammed S.A. Ph.D Thesis) allowed a great deal of choice in the cross-coupling positions and the layout shown in FIGS. 1–3 was chosen to minimise interactions of the cross couplings with each other and the diplexer junction.

TABLE 3

DIPLEXER DESIGN PARAMETERS

| PARAMETER | RECEIVE | TRANSMIT | |
|---|---|---|---|
| Filter Type | | | |
| Cross coupled | 7 el + 2 poles | 8 el + 2 poles | |
| Realisation | Combine Coupled Cavity | | |
| Q Factor | 4000 | 4000 | |
| Equiripple Bandwidth | 42 | 50 | MHz |
| Insertion Loss Bandedge | 0.55 | 0.50 | dB |
| Lowpass Filters | 4 element | | |
| Cutoff | 2.25 GHz | | |
| First Spurious Frequency | 12.5 | 13.5 | GHz |

Figure 9:
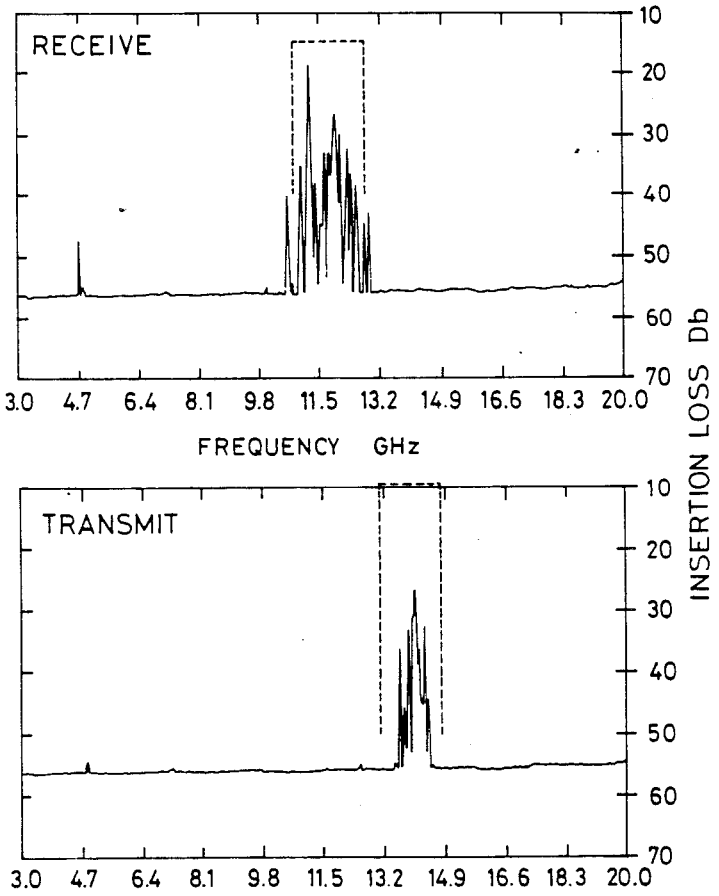
FIGS. 9*a* and 9*b* is a schematic graph illustrating the characteristics of low pass filters coupled respectively to the receive and transmit ports of the diplexer shown in FIG. 1.

The large cavities 4 pass the TEOl mode at around 4.3 GHz. To provide rejection up to 20 GHz both filter sections 2, 3 were preceded by coaxial alternating impedance lowpass filters 26, 27 designed by using Levy's approach (IEEE Trans. Microwave Theory Tech. Vol. MTT-21 Aug 79 pp 519–536) which was modified to give a constant inner diameter. By choosing the lowpass line lengths correctly it was possible to locate one of the return loss dips at the passband of the main filters and achieve a return loss over their passbands of better than 30 dB. Four element low pass filters with very short but different line lengths (15 to 18 degrees) were used. The first spurious passbands fell at different points (see FIG. 9) so that over 55 dB transmit to receive rejection was achieved to 20 GHz.

Figure 7:
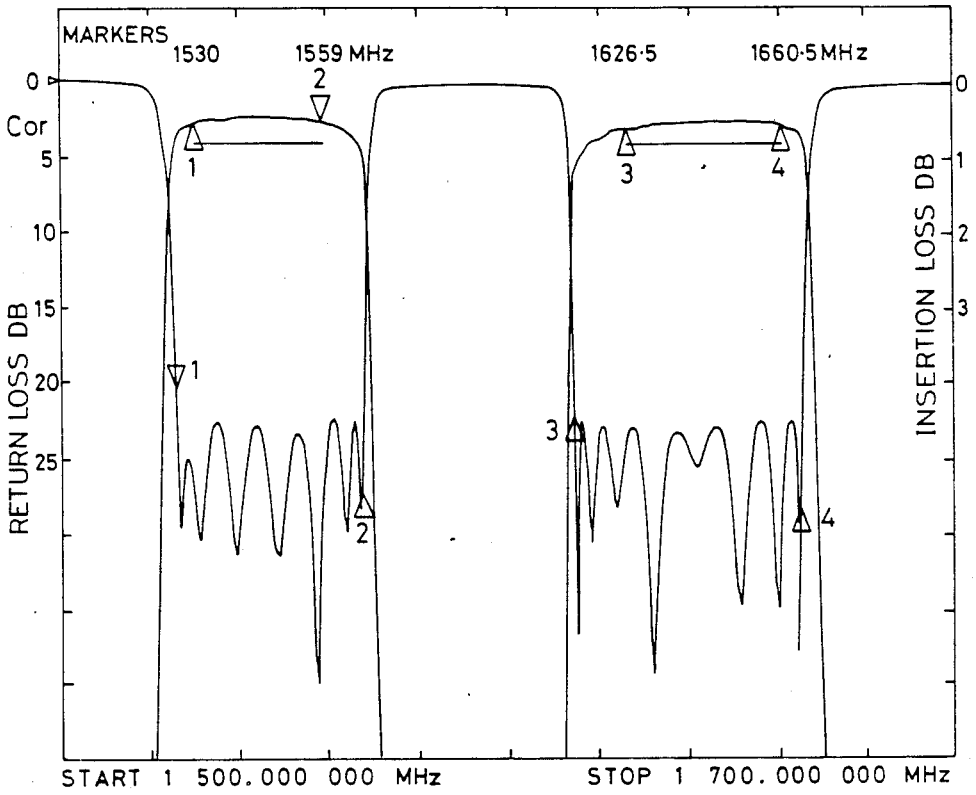
FIG. 7 is a graph showing insertion loss and return loss of a diplexer in accordance with the invention.
Figure 8:
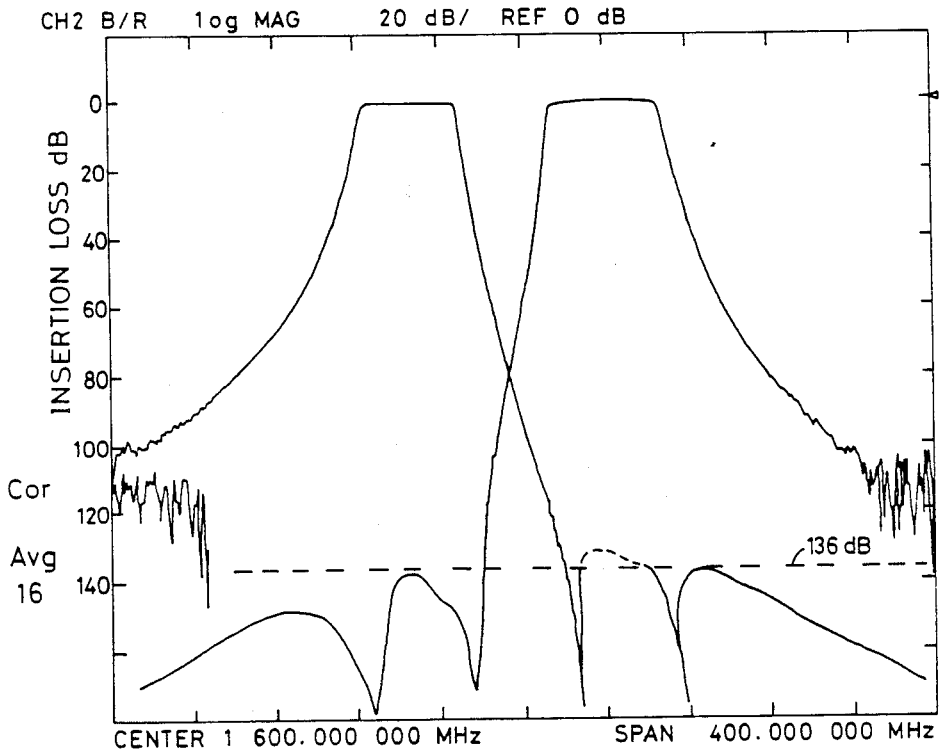
FIG. 8 is a graph showing the rejection of a diplexer in accordance with the invention.

Diplexers in accordance with the invention have proved to be relatively straightforward to set up and they showed good repeatability. Representative test results of return loss, insertion loss and rejection are shown in FIGS. 7 and 8. A low noise amplifier and spectrum analyser were used to measure down to −136 dB and these results have been superimposed upon the FIG. 8 network analyser plot.

All results were within specification and very close to theoretical predictions. The adjacent channel rejection enhancement was actually greater than expected giving rejections below the measurement limit of −136 dB.

The diplexer has been tested to 140 W CW at 35,000 ft without breakdown and this altitude limit is being extended.

It can therefore be concluded that the complex asymetrically coupled diplexer disclosed herein offers clear advantages in terms of insertion loss, rejection and volume over conventional chebycheff designs. The design is also suitable for many L Band communication systems.

Whilst a preferred embodiment of the invention has been described in detail herein, it will be understood that changes and modifications are possible without departing from the scope and spirit of the invention defined in the following claims.

I claim:

1. A diplexer comprising:

first and second signal filtering sections, a common port coupled to both of said sections, first and second ports respectively coupled to said first and second sections, wall means defining a plurality of coaxial cavities, each of said cavities having a substantially square cross-section and having a central resonator disposed therein, said cavities being disposed in each of said sections so that at least three adjacent cavities form a right triangular group in which two of said three cavities are aligned in a column and two of said three cavities are aligned in a row, the cavities in said first section having irises for coupling together respective adjacent cavities on a main path between said first port and said common port, and the cavities in said second section also having irises for coupling together respective adjacent cavities on a main path between said second port and said common port, and cross coupling means for coupling the diagonal cavities in each of said right triangular groups.

2. A diplexer according to claim 1 wherein the cavities in the first and second sections are arranged in respective rows and columns whereby the respective main paths, between said first port and said common port and between said second port and said common port, are folded back and forth.

3. A diplexer according to claim 1 wherein said cross-coupling means comprises a loop for providing inductive coupling.

4. A diplexer according to claim 1 wherein walls defining said cavities have portions of reduced cross-section except where means are provided for securing a cover.

5. A diplexer according to claim 1 wherein said common port is coupled to respective cavities in said first and second sections by a T junction and respective coupling means each comprising a wire section, each said wire section having a tapping point coupled to the central resonator of its respective cavity; the length of the wire sections and the height of the tapping point above electrical ground being selected to provide optimum diplexing.

6. A diplexer according to claim 1 and further including first and second low pass filters respectively coupled between end cavities of said first and second sections and said first and second ports, said low pass filters each having a flat plateau pass band and a peak response at some distance from the pass band plateau, the peak response of said first low pass filter occuring at a frequency which differs from that at which the peak response of said second low pass filter occurs.

7. A diplexer comprising:

first and second signal filtering sections, a common port coupled to both of said sections, first and second ports respectively coupled to said first and second sections, wall means defining a plurality of coaxial cavities, each of said cavities having a substantially square cross-section and having a central resonator disposed therein, said cavities being disposed in respective rows and columns in the first and second sections so that at least three adjacent cavities form a right triangular group in which two of said three cavities are aligned in one of said columns and two of said three cavities are aligned in one of said rows, the cavities in said first section having irises for coupling together respective adjacent cavities on a main path between said first port and said second port, and the cavities in said second section also having irises for coupling together respective adjacent cavities on a main path between said second port and said common port; said main paths, each being folded back and forth, inductive coupling means in the form of loops for coupling the diagonal cavities in each of said right triangular groups, and first and second low pass filters respectively coupled between end cavities of said first and second sections and said first and second ports, said low pass filters each having a flat plateau pass band and the peak response at some distance from the pass band plateau, the peak response of said first low pass filter occuring at a frequency which differs from that at which the peak response of said second low pass filter occurs.

8. A diplexer according to claim 7 wherein said common port is coupled to respective cavities in said first and second sections by a T junction and respective coupling means each comprising a wire section, each said wire section having a tapping point coupled to the central resonator of its respective cavity; the length of the wire sections and the height of the tapping point above electrical ground being selected to provide optimum diplexing.

* * * * *